United States Patent [19]

Anderson

[11] 4,375,052

[45] Feb. 22, 1983

[54] POLARIZATION ROTATABLE ANTENNA FEED

[75] Inventor: Tore N. Anderson, Brookfield Center, Conn.

[73] Assignee: Microdyne Corporation, Ocala, Fla.

[21] Appl. No.: 168,666

[22] Filed: Jul. 11, 1980

[51] Int. Cl.[3] ..... H01P 1/165

[52] U.S. Cl. ..... 333/21 A; 333/26

[58] Field of Search ..... 333/21 A, 26, 34, 257

[56] References Cited

U.S. PATENT DOCUMENTS

| | | | |
|---|---|---|---|
| 2,628,278 | 2/1953 | Zaleski | 333/21 A X |
| 2,865,009 | 12/1958 | Litton | 333/34 X |
| 3,296,558 | 1/1967 | Bleackley | 333/21 A |
| 3,725,824 | 4/1973 | McDonald | 333/34 X |
| 3,758,886 | 9/1973 | Landry et al. | 333/26 |
| 3,864,688 | 2/1975 | Hansen et al. . | |
| 3,924,205 | 12/1975 | Hansen et al. | 333/21 A |
| 3,938,157 | 2/1976 | Brickey | 333/21 A X |

FOREIGN PATENT DOCUMENTS

| | | | |
|---|---|---|---|
| 610040 | 12/1960 | United Kingdom | 333/34 |
| 913171 | 12/1962 | United Kingdom . | |
| 1023112 | 3/1966 | United Kingdom . | |
| 675496 | 7/1979 | U.S.S.R. | 333/26 |

*Primary Examiner*—Paul L. Gensler

*Attorney, Agent, or Firm*—Howard L. Rose; William D. Hall

[57] ABSTRACT

A wave guide of an antenna feed assembly has a wave polarization rotary section comprising a plurality of closely spaced conductive pins extending across the diameter of the wave guide. A first group of such pins adjacent the output end of the wave guide to an amplifier are stationary while a second plurality of pins are rotatable about the axis of the feed in progressive steps through each pin to 45° positions selectively to one or the other side of the plane formed by the stationary pins to rotate one or the other of the 90° polarized waves 45° into the plane of the stationary pins and thence to the amplifier. The movable pins are received in a collar rotated by a conventional motor, the pins being located in slots of varying lengths in the collar so that each rotatable pin lies at the same angle to both of its adjacent pins. A ridge plate is employed in the wave guide to coaxial connector transition to provide a ridge loaded wave guide transition section; the ridge plate extending from a wall of the circular wave guide to the center conductor of the coaxial connector with the point of contact being located such with respect for the end wall of the wave guide to provide a resonant circuit at the frequencies under consideration. A matching boss located at the contact of the ridge plate and the center conductor is employed to add capacitance and assist in providing broad band tuning.

9 Claims, 3 Drawing Figures

POLARIZATION ROTATABLE ANTENNA FEED

RELATED APPLICATIONS

This application is related to copending application, Ser. No. 168,665, filed July 11,1980 in the names of Michael S. Balbes, Charles E. Day, Robert L. Hooper and Hank S. Lin for Receive Only Earth Satellite Ground Station.

The present invention relates to antenna feed assemblies and more particularly to a polarization rotatable feed assembly for permitting the assembly to accept alternatively electromagnetic waves polarized at 90° relative to one another.

BACKGROUND OF THE INVENTION

The RCA satellite transmits 40 channels, 20 channels of a first polarization and 20 channels polarized 90° relative to the first mentioned 20 channels. Conventionally, two separate Orthomode transitions have been employed in the wave guide for the antenna feed to receive the waves of different polarization, each transition applying the received waves to a different low noise amplifier.

Wave guide Orthomode transitions and low noise amplifiers are large and expensive and as the need for lower cost earth satellite ground stations increases, it is important to reduce both size and cost of components. In copending patent application Ser. No. 168,665 filed on concurrent date herewith for Receive Only Earth Satellite Ground Station assigned to the same assignee as the present invention, there is disclosed an earth satellite ground station in which substantially the entire ground station is disposed about an antenna feed disposed at the focus of a dish antenna. The ability to accomplish this result is dependent at least in part to the ability to employ a single transition and low noise amplifier to receive complentary polarized waves.

Rotation of polarized electromagnetic waves can be accomplished by various techniques such as Faraday rotation using ferrites, but because of the environment in which the present invention is to be employed, such prior art systems are not acceptable due to the high losses introduced by these techniques and instability with temperature and frequency.

U.S. Pat. No. 3,924,205 discloses a horn for a cross-polarized parabolic antenna fed by two wave guides having their longer transverse dimension in a common plane with a 90° pin type polarization rotator located in the feed between the entry points of the two wave guides whereby one wave is rotated 90° relative to the other. Theoretically, the feed of said patent could be used in reverse in the system of the aforesaid application but such would require a long feed and two low noise amplifiers thus defeating the requirement of low cost and small size.

SUMMARY OF THE INVENTION

The invention contemplates the use of a plurality of spaced conductive and diametrically extending pins in a hollow cylindrical wave guide utilized in an antenna feed assembly to rotate incoming waves into a common plane of polarization for application to a single output terminal from the guide. A first plurality of the pins adjacent the output terminal are equally spaced from one another and aligned in a common plane along the longitudinal axis of the guide. The pins extend across the diameter of the guide and are situated at an angle of 45° to the orientation of the cross-polarized waves to be received. A second plurality of pins also extending across the diameter of the guide, are carried in slots in the guide so as to be rotatable about the axis of the guide. These pins are also carried in slots in a hollow cylindrical collar coaxial with and rotatable about the guide. A third plurality of pins is carried in slots in the guide but are fixed in the collar so as to rotate to the full extent of the collar.

The second plurality of pins are arranged in slots so as to provide a uniform twist in the magnetic field from 40° relative to the stationary pins into the plane of such pins. The third plurality of pins are aligned with the initial polarization of the field so that all of the rotation of the field is accomplished by the pins that lie in slots in both the collar and wave guide. For example, if three such pins are employed, then field rotation occurs through five pins, one at the end of the first and third group of pins and the three pins of the second group. Thus, the angular spacing between pins is 11.25°.

The slots in the guide must subtend an arc of 90° for the third plurality of pins since the collar is rotated 90° when the feed is to accept a wave of the other polarization. The slots for the second plurality of pins are reduced by 22.50° for each pin progressing from the third plurality of pins toward the stationary pins.

The diameter of the wave guide is selected so that the wave being rotated is only in the $TE_{11}$ mode. The slots in the guide are then parallel to the electric field of the wave, do not cut any longitudinal currents and thus are transparent to the wave. The collar also provides an RF shield for the slots in the guide since at the end of each rotation of the collar, the pin is at opposite ends of the slots in the guide and collar and thus the collar always covers the wave guide slots.

As indicated, the diameter of the wave guide is selected so as to support propagation of the waves in the fundamental mode ($TE_{11}$) for reasons as stated above. For satellite application, the tube diameter is approximately 2 inches fo reception of waves in the 3 to 4 GHz range. For purposes of cost reduction, a standard $2\frac{1}{8}''$ ID pipe is utilized, the difference in desired diameter having minimum effect on operation. The insertion loss of the wave guide is approximately 0.02 dB.

As a further cost saving, a standard 16 mm motion picture projector drive sprocket is employed to drive the collar via a stainless steel tape seated in a channel in the collar.

Another feature of the invention relates to the provision of a low cost, low loss, and relatively small wave guide to coaxial cable transition. The transition utilizes a ridge plate to provide a ridge loaded wave guide; the plate contacting the center conductor of the coaxial connector at a distance from the end wall of the feed through which the connector extends such as to establish a matching current loop or resonant circuit of the frequencies desired; about 0.3" for 3 to 4 GHz reception. The plate is thin and lies at right angles to the stationary pins of the guide. At the desired frequencies, the ridge plate is about $\frac{1}{4}''$ to $\frac{1}{2}''$ wide and from 3" to 6" long; preferably six inches to provide a good, low loss transition. A matching boss comprising a $\frac{1}{4}''$ cube at the desired frequencies, is positioned at the plate to center conductor contact.

The width of the ridge plate in combination with the matching boss provides the capacitance for the resonant circuit. If the ridge plate is made wider, the boss would be smaller. Broad band tuning results from the low Q of the tank circuit; the 50 ohm characteristic impedance of the coaxial connector loading the tank and producing the low Q.

It is an object of the present invention to provide a low cost feed assembly for alternatively receiving electromagnetic waves having polarizations lying at 90° relative to one another.

It is another object of the present invention to provide a pin-twist arrangement in an antenna wave guide for alternatively rotating one or the other of various 90° polarized magnetic waves into a common plane for transmission to a utilization device.

Still another object of the present invention is to utilize conventional low cost components to achieve alternative rotation of various polarized waves lying at 90° relative to one another into a common plane.

Yet another object of the present invention is to provide a wave guide to coaxial connector transition which is compact, broad band and inexpensive.

Still another object of the present invention is to provide a ridge loaded wave guide in conjunction with a resonant loop and matching boss as a wave guide to coaxial connector transition.

Certain embodiments of this invention will now be described by reference to the accompanying drawings wherein.

DESCRIPTION OF PREFERRED EMBODIMENT

Figure 1:
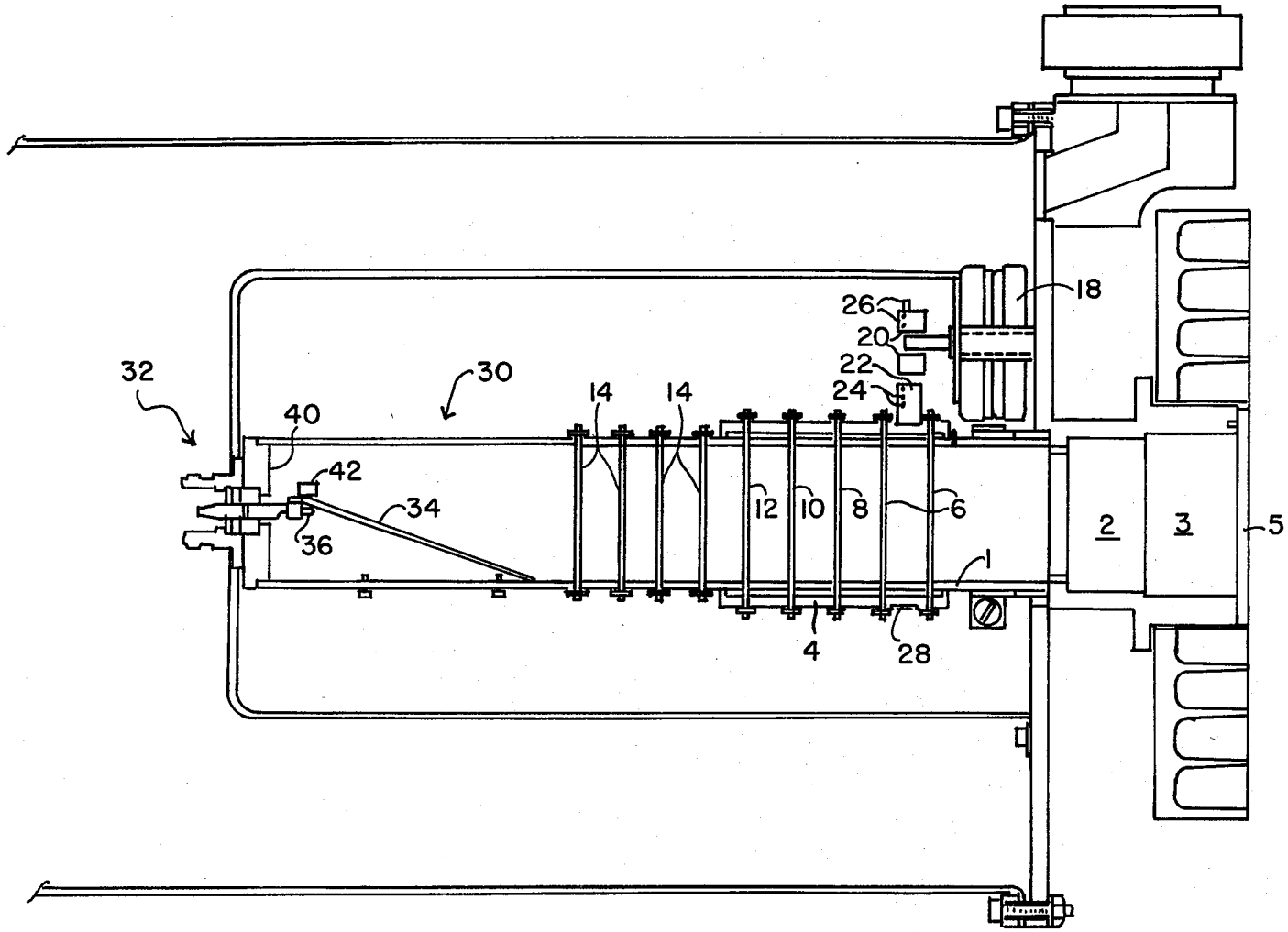
FIG. 1 is a side elevation partially in section illustrating the feed assembly of the present invention.

Referring specifically to FIG. 1 of the accompanying drawings, a hollow cylindrical wave guide 1 is fed via a one-quarter wave length matching transformer section 2 from an antenna horn 3 having a plastic window 5 located at the focus of the antenna, not illustrated, with which the feed assembly is to be employed. The dimensions of the horn 3 are determined by the frequencies to be received and the F/D ratio.

The hollow guide 1 adjacent region 2 is provided with a collar 4 in which are disposed a first plurality of pins 6 and a second plurality of pins 8, 10 and 12. The pins 6, 8, 10 and 12 extend across the diameter of the guide 1 and are made of conductive material.

Figure 2:
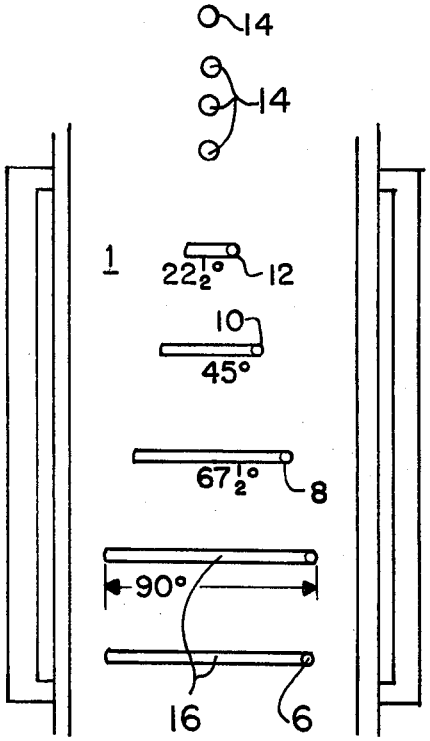
FIG. 2 is a side view in elevation illustrating the pin and slot arrangement of the pin polarizer.

An additional set of four pins 14 are secured in the guide and at any given time, are disposed at 45° relative to the pins 6. The collar 4 is rotatable through 90° about the longitudinal axis of the guide. The pins 6 are secured in the collar 4 for full rotation therewith and the orientation of the collar is such that the pins 6 are disposed at ±45° relative to the pins 14 at either extreme of ratation of the collar 4; see FIG. 3. The pins 6 are located in slots 16 see FIG. 2 in guide 1 subtending 90° arcs while the pins 8, 10 and 12 are disposed in slots subtending arcs of 67½°, 45° and 22½° respectively in the guide 1. The pins 8, 10 and 12 are also located in slots in the collar 4 of 22½°, 45° and 67½° respectively.

Figure 3:
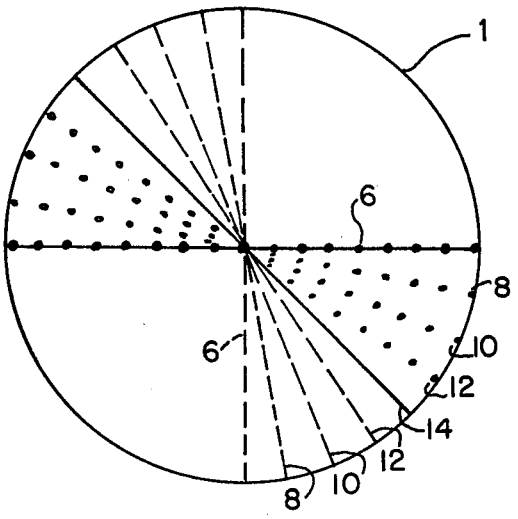
FIG. 3 is a top view diagramatically illustrating the arrangement of the pins in their two alternative positions.

In operation, assume initially that the pins are positioned in the dashed line position of FIG. 3. In this position, a wave having a polarization in the plane of the dashed line position of pins 6 is rotated through 45° into the plane of the pins 14 and are transmitted with little attenuation beyond the pins 14 to section 30 of the feed tube 1 to be explained subsequently. Waves lying at right angles to the dashed line position of pins 6 are sufficently attenuated as to be below detection level of the associated equipment.

When it is desired to receive a wave of the polarization of the dotted line position of pins 6, the collar 4 is rotated 90° counterclockwise as viewed in FIG. 3. The pins 6 rotate through the full angle of the collar and are disposed in the dotted line position of FIG. 3. The pin 8 is picked up by the collar after 22½° of rotation of the collar and thus is rotated through 67½°. Thus, the slot in the collar 4 is 22½° long and the slot in the guide 1 is 67½°. It will be noted and reference is now made of FIG. 2 of the accompanying drawings, that the pin 8 lies at the left side of the 22½° slot in the collar and at the right end of the 67½° slot in the guide. Thus, the only overlap between the slots in the collar and guide is filled with the pin 8 and the interior of the feed is fully shielded.

Continuing with the effect of rotation of the collar 4, the pin 10 is picked up after 45° of rotation of the collar and is rotated 45° while the pin 12 is picked up after 67½° of rotation of the collar and rotated 22½°. The pins 6, 8, 10 and 12 are now all in the dotted line positions of FIG. 3.

Thus, by rotation of the collar 4, the feed assembly may accept alternatively one or the other of complementary polarized waves.

Rotation of the collar 4 may be accomplished in many ways, but preferably in view of cost factor and efficiency, a stepping motor 18 commercially available from North American Philips is employed to drive a standard 16 mm movie projector sprocket 20. The sprocket 20 drives a steel tape 22 having sprocket holes 24 to receive pins 26 of the sprocket 20.

The steel tape is situated in a circumferential channel 28 in the collar 4 and is made sufficiently taught that slippage does not occur between the tape and collar.

Referring again specifically to FIG. 1 of the accompanying drawings, the guide 1 is provided with a circular wave guide to coaxial cable transition region 30 . The wave guide 1 without pins has a characteristic impedance of about 1300 ohms but with the pins it is reduced to almost 700 ohms. Thus, the section 30 must provide a broad band transition from about 700 ohms to a 50 ohms characteristic impedance of Type N coaxial connector 32.

A ridge plate 34 about ¼" wide, i.e. ¼" in a plane perpendicular to the sheet of drawing and the pins 14 and about 6 inches long extends, as viewed in FIG. 1, from the bottom most (or top most) part of the guide 1 into contact with center conductor 36 of the connector 32. The plate 34 contacts the center conductor on the side of the axis of the guide 1 remote from the side of the axis at which the wall of the guide 1 is contacted by the other end of the ridge plate 34. The ridge is soldered to the center conductor 36 at a distance from end wall 40 of the guide 1 of about ¼λ of the center frequency of the waves to be received by the feed; in this case about 0.3 inch. The gap between the ridge plate 34 and the end wall 40 performs as a tank circuit or matching current loop while the plate 34 provides a ridge loaded wave guide which reduces wave impedance and provides in part the desired impedance match. Impedance match is further enhanced by a matching boss 42 disposed on top of the ridge plate 34 over the junction with center conductor 36. The boss 42 is about a ¼" cube and is employed to add capacitance to tune the resonant circuit to the broad band of frequencies to be passed by the apparatus.

The transition provided is very compact and short, broad band and inexpensive and introduces very low losses into the circuit. The plate 34 is preferably about 6 inches long although, if necessary, may be as short as 3 inches in length.The 6 inch length, however, provides a lower loss transition.

All of these features contribute to the desired result of a low loss, low cost antenna feed assembly for use particularly in low cost earth satellite ground stations. It is apparent, of course, that the invention has much applicability in the antenna arts since the cost, size and efficiency are desirable features regardless of specific use.

It should be noted that throughout reference is made to a circular feed assembly or wave guide 1. Although not as convenient, the present invention may be utilized with a square wave guide.

Once given the above disclosure, many other features, modifications and improvements will become apparent to the skilled artisan. Such other modifications, features and improvements are, therefore, considered a part of this invention, the scope of which is to be determined by the following claims.

I claim:

1. An antenna feed assembly for selectively rotating an incoming wave in one or another direction about the axis of said feed comprising, a circular wave guide comprising an elongated hollow tube having an end for passing electromagnetic radiation, a first plurality of stationary conductive pins extending across a diametrical dimension of said hollow tube, a second plurality of conductive pins extending across a diametrical dimension of said hollow tube, said second plurality of pins being rotatable about the axis of the elongated dimension of said hollow tube, means for rotating said second plurality of pins between two extreme positions lying at equal angles on opposite sides of a plane including said first plurality of pins such that each of said pins of said second plurality of pins lie at equal angles other than zero relative to one another with at least one of said second plurality of pins remote from said first plurality of pins located at ±45° relative to said plane.

2. The apparatus according to claim 1 wherein said means for rotating comprises a collar disposed about the outer periphery of said hollow tube and coaxial with said elongated dimension, said second plurality of pins extending into said collar at both ends of said pins, and means for rotating said collar about said axis.

3. The apparatus according to claim 2 further including a plurality of diametrically opposed slots located in said hollow tube and lying in planes perpendicular to said axis of said tube, a plurality of diametrically opposed slots formed in said collar and lying in the same planes as said slots in said hollow tube, each of said second plurality of said pins disposed in slots each lying in a different one of said planes, said slots in said hollow tube and said collar defining complementary angles.

4. The apparatus according to claims 1 or 2 or 3 wherein said hollow tube is a cylindrical tube of a diameter to support propagation of a received wave in its fundamental mode.

5. The apparatus according to claims 1 or 2 or 3 wherein said hollow tube has internal dimensions to support propagation of a received wave in its fundamental mode.

6. The apparatus according to claim 3 wherein the width of said slots is approximately equal to the diameter of said second plurality of pins.

7. An antenna feed assembly for selectively rotating an incoming wave in one or another direction about the axis of said feed comprising, a circular wave guide comprising an elongated hollow tube having an end for passing electromagnetic radiation;

a first plurality of stationary conductive pins extending across a diametrical dimension of said hollow tube;

a second plurality of conductive pins extending across a diametrical dimension of said hollow tube;

said second plurality of pins being rotatable about the axis of the elongated of said hollow tube;

means for rotating each second plurality of said pins through a prescribed angle relative to said first plurality of pins and to one another such that each of said pins of said second plurality of pins lies at equal angles other than zero relative to the adjacent pins with the pin of said second plurality of pins most remote said stationary pins being rotated through the largest angle.

8. The apparatus according to claim 7 wherein said pins extend through and outwardly of said hollow tube.

9. The apparatus according to claim 7 wherein all of said pins extend across the entire diameter of said hollow tube.

* * * * *